US008664840B2

(12) United States Patent
Lin et al.

(10) Patent No.: US 8,664,840 B2
(45) Date of Patent: Mar. 4, 2014

(54) LED BULB CAPABLE OF MATING WITH LIGHT BULB SOCKETS HAVING DIFFERENT CONFIGURATIONS

(71) Applicant: Advanced Optoelectronic Technology, Inc., Hsinchu Hsien (TW)

(72) Inventors: Chih-Yung Lin, Hsinchu (TW); Min-Tsun Hsieh, Hsinchu (TW); Ching-Lien Yeh, Hsinchu (TW); Chia-Chen Chang, Hsinchu (TW); Chuan-Fu Yang, Hsinchu (TW)

(73) Assignee: Advanced Optoelectronic Technology, Inc., Hsinchu Hsien (TW)

( * ) Notice: Subject to any disclaimer, the term of this patent is extended or adjusted under 35 U.S.C. 154(b) by 0 days.

(21) Appl. No.: 13/723,202

(22) Filed: Dec. 21, 2012

(65) Prior Publication Data

US 2013/0285530 A1 Oct. 31, 2013

(30) Foreign Application Priority Data

Apr. 26, 2012 (CN) ..... 2012 1 0125762

(51) Int. Cl.
*H01J 5/48* (2006.01)

(52) U.S. Cl.
USPC ..... 313/49; 313/51

(58) Field of Classification Search
USPC ..... 313/49, 51
See application file for complete search history.

(56) References Cited

U.S. PATENT DOCUMENTS

| | | | | |
|---|---|---|---|---|
| 5,688,042 | A * | 11/1997 | Madadi et al. | 362/240 |
| 2003/0151917 | A1 * | 8/2003 | Daughtry et al. | 362/231 |
| 2012/0326623 | A1 * | 12/2012 | Fatt et al. | 315/291 |

* cited by examiner

*Primary Examiner* — Mary Ellen Bowman
(74) *Attorney, Agent, or Firm* — Altis Law Group, Inc.

(57) ABSTRACT

An LED bulb includes a bulb body and an adapter detachably connecting with the bulb body. The bulb body has two pins function as a negative electrode and a positive electrode. The two pins are for inserting into and electrically connecting with a bi-pin socket connector for light bulb, such as MR16 socket connector. The adapter includes a junction seat, a first connector, a second connector, and a bulb cap. Metallic threads are formed on the bulb cap. The first connector is received in the junction seat and electrically contacts the threads. The second connector extends through the junction seat and the bulb cap to make a bottom end thereof being exposed. The adapter is able to engage and electrically connect with an Edison screw socket connector, for example, E-10 socket connector.

20 Claims, 4 Drawing Sheets

LED BULB CAPABLE OF MATING WITH LIGHT BULB SOCKETS HAVING DIFFERENT CONFIGURATIONS

BACKGROUND

1. Technical Field

The disclosure generally relates to LED (light emitting diode) bulbs, and more particularly to an LED bulb having an adapter to make the LED bulb be capable of mating different types of light bulb socket.

2. Description of Related Art

A conventional LED bulb includes a bulb body and a holder engaging with the bulb body. A threaded periphery of the holder functions as a negative electrode to threadly engage with a light bulb socket having mating threads. The socket is used to supply current to the LED bulb whereby the LED bulb can be driven the to lighten. However, when the LED bulb is manufactured, the holder of the LED bulb can mate only one type of socket connector, which in general is either a bi-pin socket connector (for example, an MR-16 socket connector) or an Edison screw socket connector (for example, an E-10 Edison screw socket connector). Thus, the conventional LED bulbs have common problems of poor universal application.

What is needed, therefore, is an improved LED bulb which overcomes the above described shortcomings.

DETAILED DESCRIPTION

An embodiment of an LED bulb in accordance with the present disclosure will now be described in detail below and with reference to the drawings.

Figure 1:
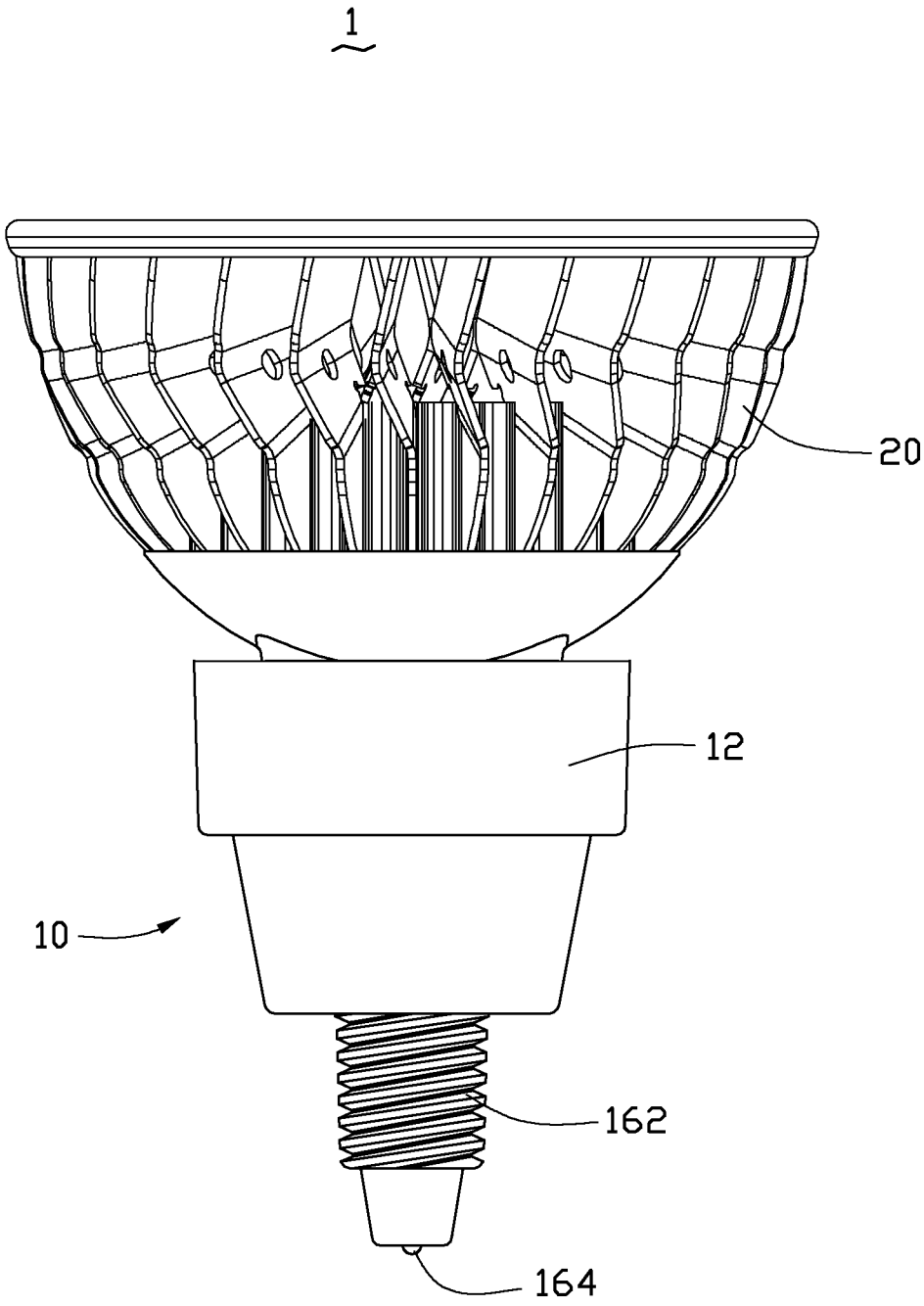
FIG. 1 is a front view of an LED bulb according to a first embodiment of the present disclosure.

Referring to FIG. 1, an LED bulb 1 of a first embodiment includes an adapter 10 and a bulb body 20 engaging with the adapter 10.

Figure 2:
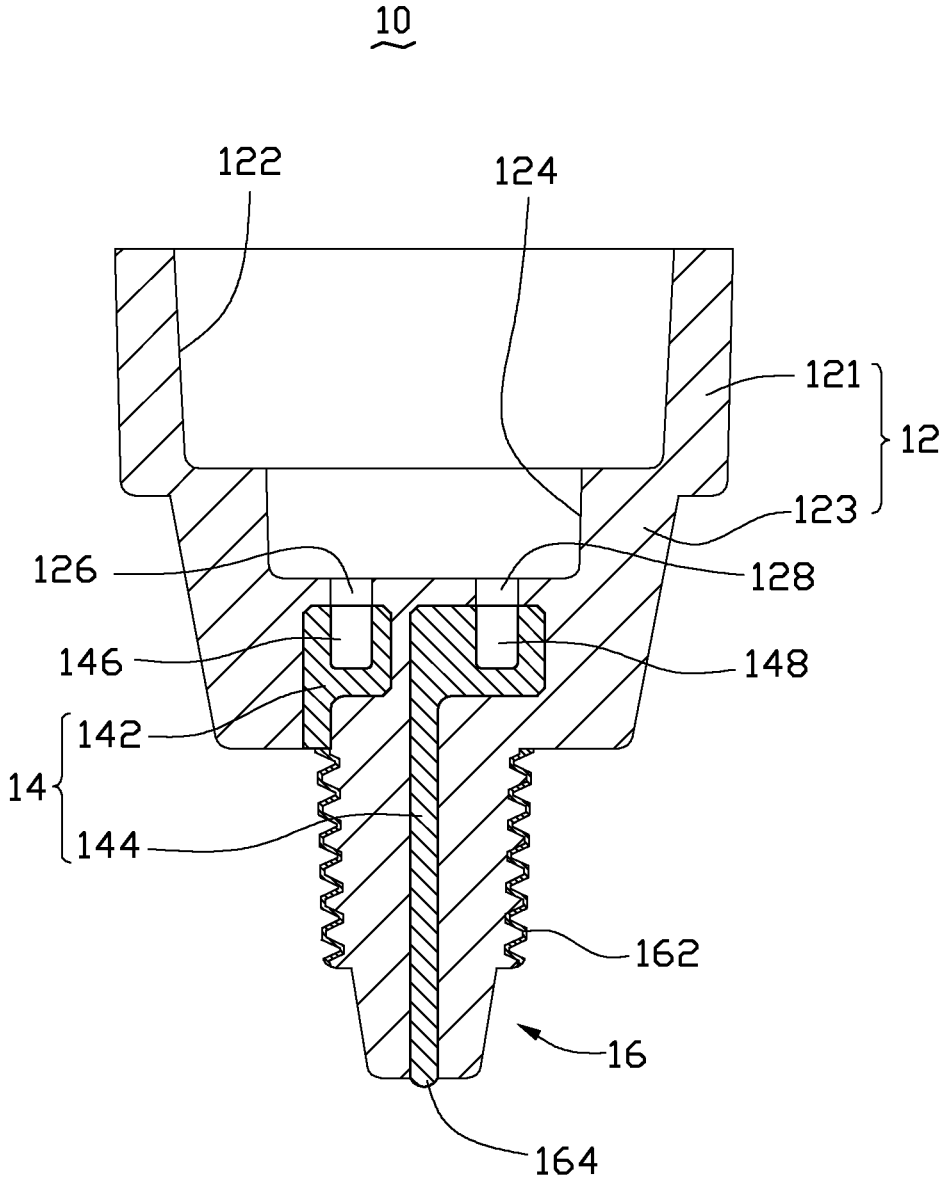
FIG. 2 is a cross-sectional view of an adapter of the LED bulb of FIG. 1.

Referring to FIG. 2, the adapter 10 includes a junction seat 12, an electrical connector 14 and a bulb cap 16. The junction seat 12 and the bulb cap 16 are made of electrically insulating material and formed as a single piece. The electrical connector 14 is received in the junction seat 12 and the bulb cap 16.

The junction seat 12 includes an upper portion 121 and a lower portion 123 extending downwardly from the upper portion 121. The upper portion 121 is cylindrical. The lower portion 123 is a frustum and has a diameter decreasing from top to bottom. A diameter of the upper portion 121 is larger than that of a top end of the lower portion 123. The lower portion 123 extends downwardly from a central portion of a bottom surface of the upper portion 121. A through hole 122 is defined in the upper portion 121. A blind hole 124 is defined in a top end of the lower portion 123. A first receiving hole 126 and a second receiving hole 128 are defined in a bottom end of the lower portion 123 and spaced from each other. The through hole 122 and the blind hole 124 are coaxial and communicate with each other. A bore diameter of the blind hole 124 is less than that of the through hole 122. The through hole 122 and the blind hole 124 cooperatively define a receiving chamber to receive a part of the bulb body 20 therein.

The bulb cap 16 is elongated. A diameter of the bulb cap 16 is less than that of a bottom end of the lower portion 123. The bulb cap 16 extends downwardly from a central portion of a bottom surface of the lower portion 123. A plurality of metallic threads 162 is formed on an outer periphery of an upper portion of the bulb cap 16.

The electrical connector 14 includes a first connector 142 and a second connector 144. The first connector 142 is received in the bottom end of the lower portion 123 of the junction seat 12. A bottom end of the first connector 142 is exposed to electronically connect with the metallic threads 162 to make the threads 162 function as a negative electrode of the adapter 10. A first recess 146 is defined in a top end of the first connector 142 and aligned with the first receiving hole 126 defined in the lower portion 123. A top portion of the second connector 144 is received in the bottom end of the lower portion 123 and a bottom portion of the second connector 144 is received in the bulb cap 26. A bottom end 164 of the second connector 144 extends out of the bottom end of the bulb cap 16 and functions as a positive electrode of the adapter 10. Accordingly, the bulb cap 16 meets an Edison screw base standard for a light bulb, for example, E-10. A second recess 148 is defined in a top end of the top portion of the second connector 144 and is aligned with the second receiving hole 128 defined in the lower portion 123.

Figure 3:
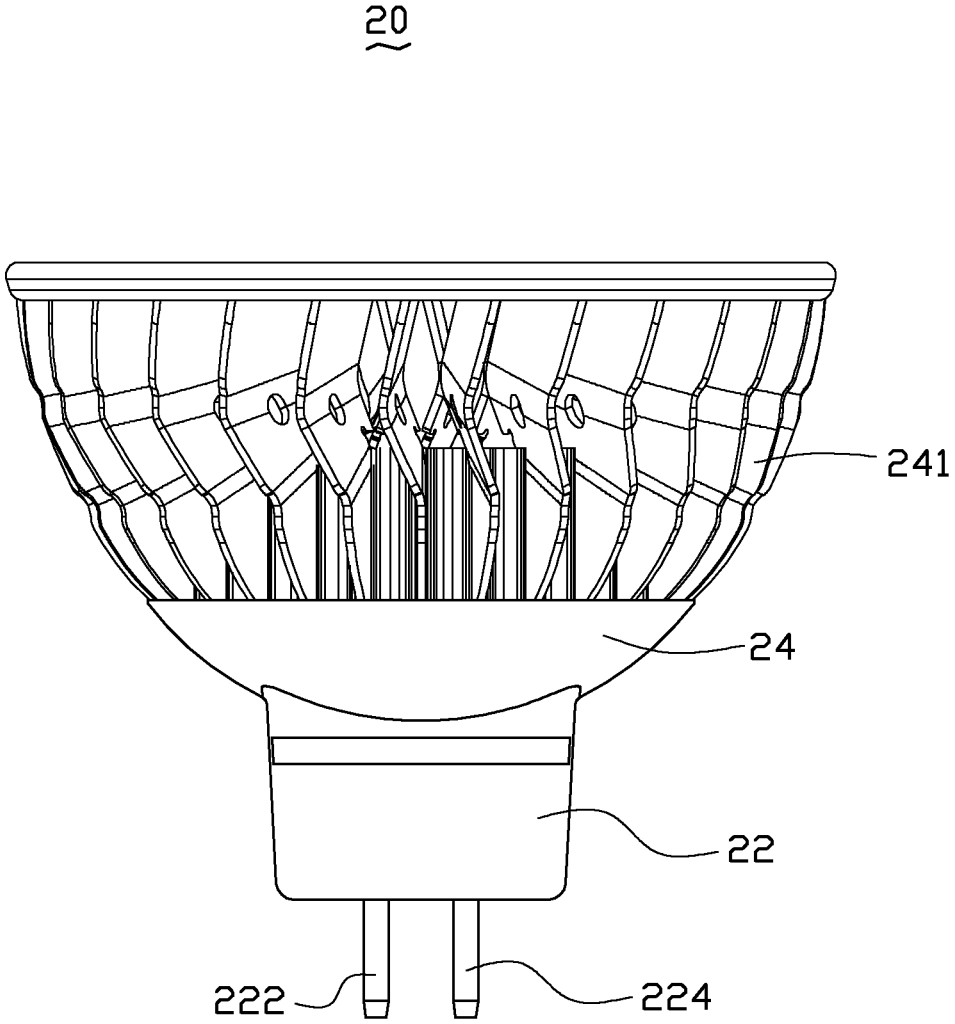
FIG. 3 is a front view of a bulb body of the LED bulb of FIG. 1.

Referring also to FIG. 3, the bulb body 20 includes a holder 22 and a bulb 24 mounted on a top of the holder 22. A plurality of fins 241 is formed on a periphery of the bulb 24. A size of a bottom end of the bulb 24 is slightly less than a bore diameter of the through hole 122 of the upper portion 121 of the junction seat 12 of the adapter 10. A diameter of the holder 22 is slightly less than a bore diameter of the blind hole 124 of the lower portion 123. Two pins 222, 224 extend downwardly from the holder 22 to respectively function as a negative electrode and a positive electrode of the bulb body 20 to electrically connect a power source, whereby current can be supplied to a light source of the bulb 24. In this embodiment, a plurality of LEDs (not shown) forms the light source of the bulb 24. The two pins 222, 224 are configured to meet a bi-pin connector standard for a light bulb, for example, MR-16.

When there is an MR-16 bi-pin socket connector (not shown) available, the LED bulb 1 without the adapter 10 can be used directly. The pins 222, 224 of the bulb body 20 are directly inserted into the mounting holes of the MR-16 socket connector and electronically connect the powder source in connection with the socket connector, whereby the bulb 24 can obtain power to lighten.

When there is an E-10 Edison screw socket connector available, the LED bulb 1 with the adapter 10 can be used. Specifically, a bottom end of the bulb 24 is received in the through hole 122 of the upper portion 121 of the junction seat 12, and the holder 22 is received in the blind hole 124 and abuts the lower portion 123. The pins 222, 224 respectively extend through the first and second receiving holes 126, 128, and are inserted into the first and second recesses 146, 148 of the first connector 142 and second connector 144, thereby electrically contacting the first connector 142 and the second connector 144. When the metallic threads 162 are threadedly engaged with the E-10 Edison screw socket connector, the metallic threads 162 and the first connector 142 electrically connect with a negative electrode of the socket connector, meanwhile the second connector 144 electrically connects with a positive electrode of the socket connector. The metallic threads 162 can engage with the threads of the socket connector.

Figure 4:
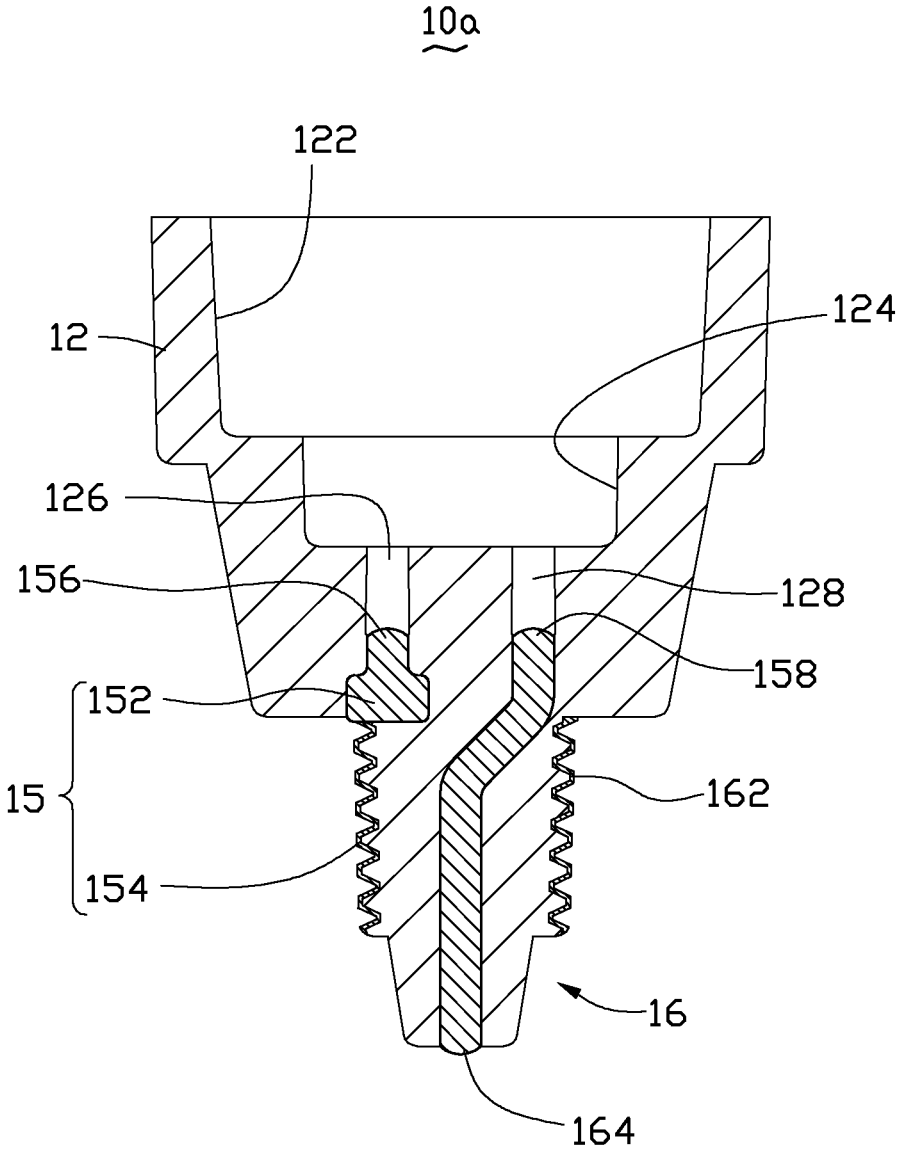
FIG. 4 is a cross-sectional view of an adapter of an LED bulb according to a second embodiment of the present disclosure.

Referring to FIG. 4, an adapter 10*a* of a second embodiment is shown. The adapter 10*a* is similar to the adapter 10 of the first embodiment except that the adapter 10*a* includes a first connector 152 without a recess defined therein. A first protrusion 156 is formed on a top end of the first connector 152. A second connector 154 is formed without a recess defined therein. A second protrusion 158 is formed on a top end of the second connector 154. The pins 222, 224 of the bulb body 20 respectively extend through the first and second receiving holes 126, 128, and electrically contact the first and second protrusions 156, 158 when the bulb body 20 engages with the adapter 10*a*.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) bulb comprising:

a bulb body having two spaced pins protruding therefrom to function as a negative electrode and a positive electrode of the bulb body, respectively, the two pins being configured for inserting into a bi-pin socket connector; and an adapter engageable with the bulb body and comprising a junction seat, a first connector, a second connector, and a bulb cap, metallic threads formed on an outer periphery of the bulb cap, the first connector being received in the junction seat and electrically contacting the threads to make the threads function as a negative electrode of the adapter, and the second connector extending through the junction seat and the bulb cap to have a bottom end thereof exposed to function as a positive electrode of the adapter, the bulb cap being configured for electrically engaging with an Edison type screw socket connector.

2. The LED bulb of claim 1, wherein the junction seat comprises an upper portion and a lower portion extending downwardly from the upper portion, a through hole is defined in the upper portion and a blind hole is defined in the lower portion, and the through hole and the blind hole cooperatively define a receiving chamber to receive a part of the bulb body therein when the bulb body is engaged with the adapter.

3. The LED bulb of claim 2, wherein the first connector is received in the lower portion to electrically contact one of the pins of the bulb body, and a top portion of the second connector is received in the lower portion to electrically contact the other pin of the bulb body.

4. The LED bulb of claim 3, wherein the bulb cap extends downwardly from a bottom surface of the lower portion, and the other part of the second connector is received in the bulb cap.

5. The LED bulb of claim 3, wherein a first receiving hole and a second receiving hole are defined in the lower portion of the transform and located at top ends of the first connector and the second connector to guide the pins extend therethrough to electrically contact the first connector and the second connector.

6. The LED bulb of claim 5, wherein a first recess is defined in a top end of the first connector and a second recess is defined in a top end of the top portion of the second connector, and the first recess and the second recess are aligned with the first receiving hole and the second receiving hole, respectively.

7. The LED bulb of claim 5, wherein a first protrusion is formed on a top end of the first connector and a second protrusion is formed on a top end of the top portion of the second connector, and the first protrusion and the second protrusion are aligned with the first receiving hole and the second receiving hole, respectively.

8. The LED bulb of claim 2, wherein the bulb body comprises a holder and a bulb mounted on the holder, the pins extend from the holder, a part of the bulb is received in the through hole and the holder is received in the blind hole.

9. The LED bulb of claim 8, wherein fins are formed on an outer periphery of the bulb.

10. A adapter for an LED bulb comprising:

a junction seat;

a bulb cap extending from the junction seat, and an outer periphery of the bulb cap formed metallic threads;

a first connector received in the junction seat and electrically contacting the threads to make the threads function as a negative electrode of the adapter; and a second connector extending through the junction seat and the bulb cap to make a bottom end thereof being exposed to function as a positive electrode of the adapter;

wherein the first and second connectors are configured to engage with two pins of an LED bulb body of the LED bulb when the LED bulb body is engaged with the adapter; and wherein the metallic threads and the exposed bottom end of the second connector are configured for electrically connecting with an Edison screw socket connector when the adapter is engaged with the Edison screw socket connector.

11. The adapter of claim 10, wherein the junction seat comprises an upper portion and a lower portion extending downwardly from the upper portion, a through hole is defined in the top portion and a blind hole is defined in the bottom portion, and the through hole and the blind hole coopreratively define a receiving chamber which is configured for receiving a part of the LED bulb body of the LED bulb therein.

12. The adapter of claim 11, wherein the first connector is received in the lower portion to electrically contact one of the pins of the bulb body, and a top portion of the second connector is received in the lower portion to electrically contact the other pin of the bulb body.

13. The adapter of claim 12, wherein the bulb cap extends downwardly from a bottom surface of the lower portion, and a lower portion of the second connector is received in the bulb cap.

14. The adapter of claim 12, wherein a first receiving hole and a second receiving hole are defined in the lower portion of the transform and located at top ends of the first connector and the second connector to guide the pins extend therethrough to electrically contact the first connector and the second connector.

15. The adapter of claim 14, wherein a first recess is defined in a top end of the first connector and a second recess is defined in a top end of the top portion of the second connector, and the first recess and the second recess are aligned with the first receiving hole and the second receiving hole, respectively.

16. The adapter of claim 14, wherein a first protrusion is formed on a top end of the first connector and a second protrusion is formed on a top end of the top portion of the second connector, and the first protrusion and the second protrusion are aligned with the first receiving hole and the second receiving hole, respectively.

17. An LED bulb comprising:

a bulb body with two spaced pins functioning as two opposite electrodes thereof; and an adapter detachably engaged with the bulb body, the adapter comprising a junction seat, a first connector, a second connector, and a bulb cap, metallic threads formed on the bulb cap, the first connector being received in the junction seat and electrically contacting the threads to make the threads function as one electrode of the adapter, and the second connector extending through the junction seat and the bulb cap to make a bottom end thereof being exposed to function as another electrode of the adapter;

wherein the adapter is selectively taken off the bulb body or mounted on the bulb body, when the adapter is mounted on the bulb body, the LED bulb being capable of engaging with one type of bulb socket connector, and when the adapter is taken off the bulb body, the LED bulb being capable of engaging with another type of bulb socket connector.

18. The LED bulb of claim 17, wherein the junction seat comprises an upper portion and a lower portion extending downwardly from the upper portion, a through hole is defined in the upper portion and a blind hole is defined in the lower portion, and the through hole and the blind hole coopreratively define a receiving chamber to receive a part of the bulb body therein.

19. The LED bulb of claim 18, wherein the first connector is received in the lower portion to electrically contact one of the pins of the bulb body, and a top portion of the second connector is received in the lower portion to electrically contact the other pin of the bulb body.

20. The LED bulb of claim 19, wherein the bulb cap extends downwardly from a bottom surface of the lower portion, and a lower portion of the second connector is received in the bulb cap.

* * * * *